US005468353A

United States Patent [19]

Anich et al.

[11] Patent Number: 5,468,353

[45] Date of Patent: Nov. 21, 1995

[54] MIST SUPPRESSANT FOR SOLVENT EXTRACTION METAL ELECTROWINNING

[75] Inventors: Ann T. Anich, St. Paul; Michael J. Sierakowski, Stillwater, both of Minn.

[73] Assignee: Minnesota Mining and Manufacturing Company, St. Paul, Minn.

[21] Appl. No.: 238,311

[22] Filed: May 5, 1994

[51] Int. Cl.[6] ..... C25C 1/12

[52] U.S. Cl. ..... 204/105 R; 204/106

[58] Field of Search ..... 204/106, 105 R

[56] References Cited

U.S. PATENT DOCUMENTS

| | | | |
|---|---|---|---|
| 2,732,398 | 1/1956 | Brice et al. | 562/30 |
| 2,750,334 | 6/1956 | Brown et al. | 205/290 |
| 2,750,335 | 6/1956 | Brown et al. | 205/290 |
| 2,750,336 | 6/1956 | Brown et al. | 205/94 |
| 2,750,337 | 6/1956 | Brown et al. | 205/290 |
| 2,759,019 | 8/1956 | Brown et al. | 564/96 |
| 2,913,377 | 11/1959 | Brown et al. | 205/94 |
| 4,484,990 | 11/1984 | Bultman et al. | 204/106 |
| 5,144,069 | 9/1992 | Stern et al. | 562/556 |
| 5,207,996 | 5/1993 | Sierakowski et al. | 423/27 |

FOREIGN PATENT DOCUMENTS

| | | |
|---|---|---|
| 2077765 | 6/1981 | United Kingdom . |
| 2250515 | 6/1992 | United Kingdom . |

OTHER PUBLICATIONS

Pike & Johannessen, "Use of Fluorosurfactants for Mist Control in Copper SX–EW" Nov., 1985.

Johannessen, Maes, Pike and Seward, "Aspects of Fluorosurfactant Use for the Control of Acid Mist in SX–EW Operations" Dec., 1985.

*Primary Examiner*—John Niebling
*Assistant Examiner*—Brendan Mee
*Attorney, Agent, or Firm*—Gary L. Griswold; Walter N. Kirn; Robert H. Brink

[57] ABSTRACT

The formation of acid mist or spray over metal electrowinning tanks, such as in the electrowinning of copper obtained by solvent extraction, is substantially inhibited or eliminated by electrowinning the metal from electrolyte containing certain fluoroaliphatic non-foam-forming surfactants.

7 Claims, No Drawings

MIST SUPPRESSANT FOR SOLVENT EXTRACTION METAL ELECTROWINNING

FIELD OF THE INVENTION

This invention relates to a method for inhibiting the formation of acidic mist above electrowinning tanks during the recovery of metal values from a solution thereof by the Solvent extraction-electrowinning process. This invention also relates to the recovery of copper by the solvent extraction-electrowinning process.

BACKGROUND

The process for recovery of elemental metal values, such as copper or nickel, from ores and processing liquids by solvent extraction-electrowinning (hereinafter "SX-EW") is well known. See, for example, U.S. Pat. No. 4,484,990 (Bultman et al.). Metal-bearing aqueous solution is obtained by dissolving from an ore the desired metal in an aqueous leach liquor. The resulting solution of metal values is mixed with a water-immiscible organic solvent (e.g. kerosene) containing a water-insoluble ion exchange composition having selective affinity for the desired metal values. The aqueous and organic phases are separated. The desired metal values are removed from the organic phase (which contains the ion exchange composition and the extracted metal values) by mixing with an aqueous strip solution containing strong acid such as sulfuric, phosphoric, or perchloric acid, and having lower pH than the metal-bearing aqueous solution. The aqueous strip solution extracts the desired metal values into the aqueous phase. After separation of the organic and aqueous phases, the desired metal values are present in the aqueous strip solution, and the resulting metal-enriched strip solution is usually referred to as "electrolyte" or "pregnant electrolyte". The desired metal is recovered in purified form by electroplating the metal from the electrolyte. After recovery of the desired metal, the metal-depleted electrolyte is usually referred to as "spent electrolyte". Such spent electrolyte can be recycled as aqueous strip solution for fresh loading with metal values by mixing with loaded organic.

During the electrowinning step, elemental metal is plated out at the electrowinning cathode and oxygen evolves at an insoluble anode. The evolution of oxygen gas forms bubbles which entrain strong acid electrolyte, carrying it into the air above the electrowinning tank in the form of a fine mist or spray when the bubbles break. This mist or spray then spreads throughout the electrowinning tankhouse. The acidic mist is corrosive and a health hazard and can cause extreme discomfort to the skin, eyes, and respiratory systems of tankhouse workers, especially during hot weather conditions.

Certain fluorochemical surfactants have been used in chromium plating baths to promote the formation of a foam at the surface of the plating bath. This foam is said to effectively eliminate the formation of chromic acid mist. Such fluorochemical surfactants are described, for example, in the Brown et al. U.S. Pat. Nos. 2,750,334, 2,750,335, 2,750,336, and 2,750,337. Such surfactants proved unsatisfactory for inhibiting acidic mist formation above electrowinning tanks used in the SX-EW process. For example, the conventional chromium plating fluorochemical mist suppressant $C_8F_{17}SO_3K$ gave good initial foam formation and mist suppression above a copper electrowinning tank, but the fluorochemical was rapidly extracted into the organic phase during recycling of the electrolyte. In addition, the fluorochemical surfactant $C_8F_{17}SO_3K$ was found to interfere with copper recovery and to retard phase separation between organic and aqueous phases when used with ion exchange compounds such as "Acorga P5300" (commercially available from Imperial Chemical Industries, Ltd.) and "LIX 64N" (commercially available from Henkel Corporation).

U.S. Pat. No. 2,913,377 (Brown et al.) describes the use of certain perfluoroalkane sulfonic acids to minimize the formation of mist and spray during anodization.

U.S. Pat. No. 4,484,990, supra, discloses a process for recovery of metal values by the SX-EW process wherein certain fluoroaliphatic surfactants are used in the electrolyte to provide mist-inhibiting foam on the surface of the electrolyte. See also, Pike and Johannessen, "Use of Fluorosurfactants for Mist Control in Copper SX-EW," prepared for presentation at a symposium on hydrometallurgy in Santiago, Chile, November, 1985, and Johannessen, Maes, Pike, and Seward, "Aspects of Fluorosurfactant Use for the Control of Acid Mist in SX-EW Operations," prepared for presentation at the Annual Meeting of the Arizona Conference of AIME in Tucson, Ariz., December, 1985.

BRIEF DESCRIPTION OF THE INVENTION

In one aspect, the present invention provides a method for recovery of metal values comprising the steps of (A) leaching metal ore, for example, copper ore, with an aqueous acidic solution to produce an aqueous acidic solution containing metal values, (B) liquid-liquid solvent extraction of said metal values from said aqueous acidic solution containing metal values to produce an organic solvent solution containing metal values, (C) stripping of said metal values from said organic solvent solution containing metal values into an acidic aqueous solution containing strong acid to produce an electrolyte containing metal values, (D) electrowinning of said metal values from said electrolyte containing metal values in an electrolytic cell, said cell comprising one or more insoluble anodes and a metallic cathode, and (E) recycling said electrolyte after step (D) for re-use in step (C). The improvement comprises electrowinning said metal values from electrolyte containing sufficient fluoroaliphatic surfactant to inhibit the formation of acidic mist above said electrolyte. The fluoroaliphatic surfactants useful in this invention are soluble in said electrolyte, are not significantly extracted in said organic solvent solution, do not interfere with the solvent extraction step, for example by inhibiting phase separation after extraction, and do not form a foam blanket on the surface of the electrolyte during the electrowinning step.

As used herein, "formation of a foam blanket" means formation of a continuous layer of foam of thickness of at least 1 mm. As used herein, "inhibit the formation of acid mist" means that the amount of acid mist formed over time is less than in control samples which do not contain surfactant or other means for inhibiting mist formation.

The surfactants claimed by Bultman et al. produce foam. A small amount of solvent from the solvent extraction step is present in the electrolyte and can become trapped in the foam bubbles which also contain oxygen gas. Thus, while the foam does inhibit acid mist formation, the foam bubbles also present a potential fire hazard. The method of the present invention provides for acid mist suppression without producing a foam cover, thus reducing the potential fire hazard from solvent entrapment.

DETAILED DESCRIPTION OF THE INVENTION

Fluorosurfactants useful in the present invention are those that do not interfere with either the extraction kinetics or the phase disengagement (i.e. separation) time of the aqueous and organic phases used during solvent extraction. Generally this means that the surfactants should be soluble and stable in the tankhouse electrolyte but have very low solubility in the water-immiscible organic solvent used in the solvent extraction step. In addition, the surfactants useful in this invention are generally those that lower the surface tension of the electrolyte less than those claimed by Bultman. Generally, the surfactants useful in this invention lower the surface tension of aqueous sulfuric acid to between from about 25 to 65 dynes/cm. This is because the surfactants useful in the present invention are those that stabilize the oxygen bubbles produced during electrowinning well enough so that they slowly drain after reaching the electrolyte surface and not burst immediately, to prevent splattering and acid mist formation, but not so well as to produce a continuous stable foam surface and consequent ion-exchange solvent entrapment.

A particularly preferred class of surfactants are those having lower perfluoroaliphatic chain length (typically from about 4 to 8 carbon atoms). A class of such surfactants can be represented by the following Formula I:

$$(R_f)_n(Q)_xZ \qquad \text{I}$$

In Formula I, $R_f$ is a fluoroaliphatic radical or group, and n is 1 or 2. $R_f$ can be generally described as a fluorinated, preferably saturated, monovalent, non-aromatic radical of 4 to 8, carbon atoms. The fluoroaliphatic radical may be straight or branched and may include oxygen, hexavalent sulfur, or trivalent nitrogen atoms bonded only to carbon atoms. A fully fluorinated radical is preferred, but hydrogen or chlorine atoms may be present in the radical provided that not more than one atom of either is present for every two carbon atoms. The fluoroaliphatic radical preferably contains about 40% to about 78% fluorine by weight, more preferably about 50% to about 78% fluorine by weight. The terminal portion of the $R_f$ radical is a perfluorinated moiety which will preferably contain from 7 to 17 fluorine atoms, e.g., $CF_3CF_2CF_2$—, $(CF_3)_2CF$—, $F_5SCF_2$—, or the like. Particularly preferred $R_f$ radicals are fully or substantially fluorinated and are preferably those perfluorinated aliphatic radicals of the formula $C_nF_{2n+1}$ where n is from 4 to 6 or perfluorinated cycloaliphatic radicals of the formula $C_nF_{2n-1}$ where n is from 6 to 8.

In Formula I, Q is a linking group and x is 0 or 1. Note that when x is 0, Q is absent and $R_f$ and Z are linked by a covalent bond. Q is a multivalent linking group such as alkylene (e.g., methylene, ethylene, or cyclohexylene), arylene (e.g., phenylene), or combinations thereof (e.g., xylylene). Q can contain moieties containing hetero atoms such as oxy, thio, carbonyl, sulfonyl, sulfinyl, sulfonamido, carbonamido, ureylene, carbamato, and imino. In other words, Q can be sulfonamidoalkylene, carbonamidoalkylene, oxydialkylene (e.g., —$C_2H_4OC_2H_4$—), thiodialkylene (e.g., —$C_2H_4SC_2H_4$—), alkylenecarbamato, and the like. Q serves to link $R_f$ and Z, and any Q that does not interfere with the functioning of the surfactant will be suitable. The choice of Q will often depend upon the specific reactants used in preparing the surfactant.

In Formula I, Z is a water-solubilizing polar group or moiety and is such that the fluoroaliphatic surfactant is soluble in, but not degraded in, the electrowinning solution under electrowinning conditions. Furthermore, Z is such that the fluoroaliphatic surfactant is not significantly extracted into the organic solvent and does not cause emulsification during the solvent extraction step.

The water-solubilizing group Z can be a moiety or group which is anionic in the electrowinning solution, such as sulfonates and sulfates, e.g., —$SO_3M$ or —$OSO_3M$, where M is a hydrogen or metal ion such as sodium or potassium, or where M is an ammonium or other nitrogen based cation.

The water-solubilizing group Z can be a moiety or group which is cationic or amphoteric in the electrowinning solution. Typical cationic groups include —$NR_2$ and —$N^+R_3A^-$, where each R is independently hydrogen or lower alkyl such as methyl, ethyl or butyl, and $A^-$ is an anion such as chloride, sulphate, phosphate, hydroxyl, etc. Typical amphoteric groups include groups such as —$N^+(CH_3)_2C_2H_4CO_2^-$ and —$SO_2N(CH_2CH_2CO_2^-)C_3H_6N^+(CH_3)_2H$.

The water solubilizing group Z can be a moiety or group which is nonionic in the electrowinning solution as long as such group does not cause the surfactant to be significantly extracted into the organic solution during solvent extraction. Suitable nonionic groups are for example poly(oxyethylene) groups containing greater than about 10 repeat units.

Examples of unsuitable nonionic Z groups include those carboxylate and phosphate groups which are nonionic in the acidic electrowinning solution. Also, Z cannot be a poly(oxyalkylene) group which is predominately composed of oxypropylene units or which contains less than about 10 oxyalkylene repeat units.

It should be noted that many of said fluoroaliphatic surfactants useful in the practice of this invention are mixtures of homologous fluorochemical compounds and can also contain fluoroaliphatic precursors and by-products from their preparation. Such mixtures are frequently just as useful as the individual fluorochemical compounds with respect to their surfactant properties. The fluoroaliphatic radical $R_f$ is often such a mixture and a fluoroaliphatic surfactant is frequently described in terms of the $R_f$ radical present in major proportion.

The surfactants used in the present invention are added in amounts sufficient to minimize or suppress mist formation during electrowinning. Preferably, such surfactants will have surface activity that provides a surface tension in the aqueous electrowinning solution at 25° C. which is between about 25 to 65 dynes/cm at a concentration of less than or equal to 0.02 weight % surfactant. The amount of surfactant added to the electrowinning electrolyte will generally be between about 10 to 200 parts by weight of surfactant per million parts by weight of electrowinning electrolyte. Replenishment of the surfactant will generally be needed in continuous SX-EW processing. The fluoroaliphatic surfactants used in this invention can be added to the electrolyte periodically or continuously. Surfactants which are in solid form can, if desired, be added in solid form or in the form of solutions such as water solutions. Addition of surfactant can take place in the electrowinning cell or at other SX-EW processing locations such as the electrolyte exchanger, settling tanks, or mixing tanks.

Addition of the fluoroaliphatic surfactants used in this invention to an SX-EW processing stream can increase the time required for thorough phase separation of the organic phase and acid electrolyte. Such time required for thorough phase separation can be reduced by carrying out phase separation at an elevated temperature, for example the organic phase and acid electrolyte can be heated to about 40° C. to counteract any slowdown in phase separation caused by addition of surfactant.

In the practice of the present invention, the manipulative steps and condition of leaching of metal ore, solvent extraction, and electrowinning which are improved by this invention are otherwise conventional steps or techniques. The electrolyte to be treated with the fluoroaliphatic surfactants used in the invention is ordinarily prepared by conventional SX steps, using conventional organic SX solvents, ion exchange compositions, and aqueous metal-bearing and electrolyte solutions, and generally conventional SX-EW processing conditions. Such organic SX solvents, ion exchange compositions, aqueous solutions, and processing conditions are well-known to those skilled in the art, and for purposes of brevity will not be described in great detail herein.

EXAMPLES

The following examples are offered to aid understanding of the present invention and are not to be construed as limiting the scope thereof.

Copper Electrowinning (EW) Cell Test

Laboratory copper plating experiments with tankhouse electrolyte were conducted using a small scale electrowinning cell constructed of clear polyvinyl chloride plastic, which was 19.5 cm long by 8.5 cm wide by 13.5 cm deep with holes at the entrance end (about 1 inch from the cell top) and at the exit end (about midway up the side), and containing an array of four lead anodes and three copper cathodes, each electrode of dimensions 9 cm high by 7.5 cm wide. Experiments were run under both dynamic and static conditions. For dynamic conditions, electrolyte solution was allowed to flow in and out of the test cell by attaching rubber tubing sections to its entrance and exit holes, connecting a 500 mL graduated addition funnel with stopcock to the other end of the entrance tubing section, and collecting into a 1 L beaker the electrolyte solution flowing out of the cell through the exit tubing section. A small piece of glass tubing with an upward curve was connected to the exit hole on the inside of the cell container to maintain the electrolyte liquid height to a level about 1 cm below the top of the electrodes during operation of the test cell. For static conditions, the entrance and exit holes of the cell were plugged to stop the flow. Electrolyte temperature was adjusted by prewarming the electrolyte solution and was monitored during each experiment using a thermometer hung in the cell away from the electrodes. The power supply used was direct current, with a current range of 0 to 10 amps.

For each experiment, the tankhouse electrolyte was made by mixing 120 g $CuSO_4.5H_2O$ with 400 g concentrated (95–98%) $H_2SO_4$ and diluting to 2 L with deionized water, to which the desired amount of fluorochemical surfactant (usually 50 ppm) was added. The test cell was filled with 1,050 mL of the electrolyte with fluorosurfactant. For experiments under dynamic conditions, about 500 mL of electrolyte with fluorosurfactant was poured into the addition funnel and flow rates were controlled by adjusting the position of the stopcock. A piece of wet Colorphast™ pH paper, pH range 0–14 (available from EM Science), 74 mm long by 6 mm wide, was suspended exactly ½ inch (12.7 mm) above the electrolyte solution (halfway between the second anode and second cathode from the solution entrance hole and halfway between either side of the cell, with the front of the pH paper facing the anode) to measure degree of acid splattering occurring during electrowinning experiments. The pH paper was suspended 10 minutes after the commencement of each test to allow for equilibrium conditions to be established, and the time recorded was the elapsed time for the measured pH to change from the initial value of 6 down to 2. If the elapsed time was longer than the time for a control sample without any means for inhibiting mist formation, then mist formation was deemed to have been inhibited.

Foam and Mist Suppression Jar Test

A small-scale, electrowinning mist suppression test was developed for rapid screening of fluorosurfactant candidates. For this test, a Teflon™ stopper was constructed by cutting a bevelled circle from a 1.9 cm thick Teflon™ slab of appropriate size to fit as a stopper into the top of an 8 oz mayonnaise jar. Two parallel vertical slits, each 3.5 cm long and 2.5 cm apart, were cut in the center of the Teflon™ stopper. In the slits were inserted a lead anode of dimensions 13.3 cm long by 3.0 cm wide by 0.16 cm thick and a copper cathode of dimensions 13.3 cm long by 3.0 cm wide by 0.08 cm thick, with 1 cm of exposed metal sticking out at the top of the stopper. The exposed metal was wrapped in Teflon™ tape to hold each electrode firmly in place. Teflon™ tape was also used to wrap the perimeter of the stopper so it would fit more snugly into the mayonnaise jar. 200 g of electrolyte solution containing 50 ppm fluorosurfactant (made by diluting 1.00 g of a 1% by weight fluorosurfactant solution in electrolyte with 199 g of electrolyte) was poured into the jar and, when stoppering the bottle, a strip of wet pH paper was held in place between the stopper and bottle neck facing inward between the cathode and anode (about 1 cm from the anode) so that the bottom of the pH strip was 0.7 cm above the electrolyte. (The electrolyte and pH paper were the same as used in the Copper Electrowinning Cell Test Procedure.) Alligator clip leads were connected to the lead anode (positive) and to the copper cathode (negative) and a current of 1.1 amps was applied for 3 minutes. Mist suppression was rated "good" if the pH paper showed no color change from acid or slight color change, and was rated "poor" if a significant color change was noted. Note that because this test does not evaluate at times less than 3 minutes, samples rated "poor" could include samples with no mist suppression or inhibition.

Solvent Extraction (SX) Experimental Procedure

The following procedure was used to determine whether the fluorosurfactant was extracted from the electrolyte into the SX organic resin, which would lead to undesirable depletion of the fluorosurfactant from the electrolyte.

The first step was to preload the ion-exchange resin with copper ion. In an 8 oz mayonnaise jar was added 85 mL of copper loading solution (11.8 g/L $CuSO_4.5H_2O$ in deionized water, with sufficient $H_2SO_4$ added to bring the pH down to 2.2) and 85 mL of SX organic resin (7:93 volume ratio of Acorga™ M-5640, available from Zeneca Specialties, and Orfom™ SX-7, available from Phillips Petroleum). A 4.4 cm diameter mixing blade was positioned at the liquid-liquid interface and the two phases were mixed for 10 minutes at 2000 rpm. The contents were then poured into a 250 mL separatory funnel and were allowed to phase-separate over a five minute period. The aqueous phase was removed from the bottom, disposed of, and the copper ion-enriched SX organic phase (loaded organic) was saved.

The second step was to prepare the electrolyte by mixing 60 g $CuSO_4.5H_2O$ with 200 g concentrated $H_2SO_4$ and diluting to 1 L with deionized water. For the experiments including fluorosurfactant, 0.50 g of a 1% by weight surfactant solution in electrolyte was added to 99.50 g of electrolyte to give 50 ppm surfactant concentration.

The final step was to add 85 mL of loaded organic from the first step and 100 g of electrolyte from the second step to a clean 8 oz mayonnaise jar and mix for 10 minutes using the same procedure as described in the first step. After mixing, the contents were poured into a 250 mL separatory funnel and the aqueous phase was collected and saved for a second cycle of mist suppression testing.

Surface Tension Measurement Procedure

Surface tensions in the examples which follow were measured using a Kruess Processor Tensiometer, model K12, with 665 Dosimat via the Wilhelmy Plate Method. Using this procedure, 50 mL (57.45 g) of blank (no fluorosurfactant) electrolyte of the same composition as given in the Copper Electrowinning Cell Test Procedure was added to the glass cup (6.65 cm diameter by 3.75 cm height), the desired amount of fluorosurfactant was added with the dosing device, and the solution was stirred. Then after waiting for 180 sec., surface tension readings in dynes/cm were taken automatically every 30 seconds until the standard deviation from five consecutive readings was 0.07 dynes/cm or less; the last surface tension average was the value used in the tables of the examples.

The following fluorosurfactants were prepared and evaluated for mist suppression.

Preparation of $C_4F_9SO_2N(C_2H_4COOH)C_3H_6N(CH_3)_2$

To a 1-L three-neck flask equipped with an air stirrer, thermometer and reflux condenser was added 300 g of toluene and 75 g (0.74 mole) of N,N-dimethylaminopropylamine. The contents were mixed at room temperature to quickly form a homogeneous solution. While stirring was continued, 206 g (0.62 mole) of $C_4F_9SO_2F$ (90% purity) was added over a 30 minute period, and a slurry was formed. The slurry was then heated to 90° C. and was allowed to reflux for 3 hours. The precipitate, which still remained, was $C_4F_9SO_2N(H)C_3H_5N^+(CH_3)_2(H).F^-$, the hydrofluoride salt of the fluorochemical sulfonamidoamine.

To this slurry was added in several aliquots a total of 55 g of KOH and 110 g of deionized water, with pH measurements taken after addition of each aliquot. After the pH had increased to 9, indicating that sufficient KOH had been added to completely neutralize the hydrofluoride salt to produce the toluene-soluble sulfonamidoamine, $C_4F_9SO_2N(H)C_3H_6N(CH_3)_2$, the mixture was stirred for about 15 minutes at 90° C. and split into two fairly homogeneous phases. The lower aqueous phase, containing byproduct KF, was discarded, and the upper toluene phase was stripped at 135° C. and atmospheric pressure to give 105 g of crude $C_4F_9SO_2N(H)C_3H_6N(CH_3)_2$, which was purified by washing five times with 300 g aliquots of deionized water, followed by a 100 g aliquot of isopropanol. 75 g of purified $C_4F_9SO_2N(H)C_3H_6N(CH_3)_2$ was recovered as a gray powder.

An acrylic acid Michael addition reaction was then run according to the general procedure given in U.S. Pat. No. 5,144,069 (Stern et al.). 50 g (0.12 mole) of the purified $C_4F_9SO_2N(H)C_3H_6N(CH_3)_2$, 16.4 g (0.23 mole) of acrylic acid and 0.2 g of phenothiazine (free radical polymerization inhibitor) were added to a 250-mL three-neck flask equipped with an air stirrer and thermometer. The resulting mixture was heated to 125° C. and was allowed to react for 6 hours. After this reaction period, a positive solubility check of the product in water of pH 7 indicated that the Michael addition reaction was essentially complete. While still mixing, a solvent blend of 18 g of diethylene glycol monobutyl ether and 42 g of deionized water was added and the mixture was allowed to cool to room temperature. The water solubility test was run again with the same positive result, showing good conversion to the desired Michael addition product, $C_4F_9SO_2N(C_2H_4COOH)C_3H_6(CH_3)_2$.

Preparation of $C_6F_{11}C(O)N(H)C_3H_6N(CH_3)_2$

To a 5-L three-neck flask equipped with stirrer, addition funnel, reflux condenser, and thermometer were added 600 g (5.8 moles) of N-N-dimethyl-3-aminopropylamine and 2500 g of diisopropyl ether. Then, 1286 g (3.1 moles) of undecafluorocyclohexanecarbonyl fluoride (75% purity by gc analysis) was added from the addition funnel, with stirring. The addition rate was sufficiently slow to keep the reaction temperature below the boiling point of ether. After completion of acid fluoride addition, the reaction mixture was stirred for 4 hours while cooling gradually to room temperature. Deionized water (2000 mL) was added to the flask and was mixed with the ether phase to extract ionic impurities. The water phase was discarded, and the extraction was repeated with another 2000 mL aliquot of water. After again discarding the water phase, the ether was removed by distillation at atmospheric pressure, then the remainder of the material was distilled at 110°–130° C. and 6 tort to give the desired product, N,N-dimethyl-3-aminopropyl undecafluorocyclohexane carboxamide, which was recovered as a thick yellow liquid. A total of 965 g (63% yield) of distilled product was obtained.

Preparation of $C_6F_{11}C(O)N(H)C_3H_6N^+(CH_3)_2C_2H_4COO^-$

A 2-L three-neck flask equipped with stirrer, reflux condenser, and thermometer was charged with 484 g (1.0 mole) of N,N-dimethyl-3-aminopropyl Undecafluorocyclohexane carboxamide, 86 g (1.2 mole) of acrylic acid, and 0.1 g of phenothiazine and was heated with stirring for 4 hours at 130° C. Heating was discontinued and 570 g of deionized water was added resulting in 1140 g of a viscous, black solution (50% wt. solids). The solids in this solution was found by proton nmr analysis (using chemical shifts) to consist of the following: 78% $C_6F_{11}C(O)N(H)C_3H_6N^+(CH_3)_2C_2H_4COO^-$, 17% $C_6F_{11}C(O)N(H)C_3H_6N^+(CH_3)_2(H).CH_2{=}CHCOO^-$, and 6% $C_6F_{11}C(O)N(C_2H_4COOH)C_3H_6N(CH_3)_2$.

Preparation of $CF_3{-}C_6F_{10}C(O)N(H)C_3H_6N^+(CH_3)_2C_2H_4COO^-$

To a 5-L flask equipped with stirrer, addition funnel, reflux condenser, and thermometer were added 402 g (3.9 moles) of N,N-dimethyl-3-aminopropylamine and 2000 g of diisopropyl ether. Then, with stirring, was added from the addition funnel 1280 g (2.8 moles) of tridecafluoro-(4-methylcyclohexane)carbonyl fluoride (62% acid fluoride by gc analysis). The addition rate of sulfonyl fluoride was adjusted to keep the solution temperature below the boiling point (60° C.) of the ether. After addition was complete, the reaction mixture was stirred at room temperature for 4 hours. The ether solution was washed twice with 2000 mL aliquots of deionized water, then the ether was removed by distillation at atmospheric pressure. The desired product, N,N-dimethyl-3-aminopropyl tridecafluoro-(4-methylcyclohexane)carboxamide, was distilled at 120° C. to 140° C. and 6 torr as a thick yellow liquid, resulting in 744 g (49% yield) collected.

A 2-L flask equipped with stirrer, reflux condenser, and thermometer was charged with 300 g (0.55 mole) of N,N-dimethyl-3-aminopropyl tridecafluoro-(4-methylcyclohexane)carboxamide, 47 g (0.65 mole) of acrylic acid, and 0.1 g of phenothiazine and was heated with stirring for 4 hours at 130° C. Heating was discontinued and 347 g of deionized water was added, resulting in 694 g of a viscous black solution (50% solids). The solids in this solution were found by proton nmr analysis to consist of the following:

73% $CF_3{-}C_6F_{10}C(O)N(H)C_3H_6N^+(CH_3)_2C_2H_4COO^-$,

21% $CF^3{-}C_6F_{10}C(O)N(H)C_3H_6N^+(CH_3)_2(H).CH_2{=}CHCOO^-$, and

6% $CF_3{-}C_6F_{10}C(O)N(C_2H_4COOH)C_3H_6N(CH_3)_2$.

Preparation of $C_6F_{13}SO_3^-K^+$

The preparation of $C_6F_{13}SO_3^-K^+$ is described in U.S. Pat. No. 2,732,398 (Brice et al.), Example 4.

Preparation of $C_2F_5{-}C_6F_{10}SO_3^-K^+$

The preparation of $C_2F_5{-}C_6F_{10}SO_3^-K^+$ is described in U.S. Pat. No. 2,732,398, Example 8. This product is available from 3M Company as Fluorad™ Fluorochemical Surfactant FC-98.

Preparation of $C_4F_9SO_2N(H)C_3H_6N^+(CH_3)_3\ Cl^-$

To a 2-L flask equipped with stirrer, condenser, dropping funnel, and thermometer were charged 214.2 g (2.0 moles) of N,N-dimethylaminopropylamine and 500 g of n-heptane. The resulting solution was stirred and from the dropping funnel was slowly added 331 g (1.0 mole) of $C_4F_9SO_2F$ (91% purity), keeping the temperature at 30°–35° C. The mixture was allowed to react for 2 hours at 45° C., and the precipitate which formed was filtered, washed with heptane, and allowed to dry at room temperature to give 506 g of crude amidoamine product. The crude product was slurried with 400 mL of deionized water, filtered, reslurried with 500 mL of water, and filtered again. The purified product was dried at 60° C. in a vacuum oven until dry to give 312 g of $C_4F_9SO_2N(H)C_3H_6N(CH_3)_2$ (81.2% yield), analyzed to be 97.9% pure by $HClO_4$ titration.

To a glass pressure reactor was charged 76.8 g (0.2 mole) of $C_4F_9SO_2N(H)C_3H_6(CH_3)_2$ and 150 mL of acetone. After heating the reactor with stirring to 45°–50° C., 13 g (0.25 mole) of methyl chloride from a gas cylinder was pressure-vented into the reactor over about a two hour period. After 4 hours, the pressure in the reactor stabilized, the reactor was opened, and the resulting paste was allowed to dry at ambient conditions. The crude product was slurried with cyclohexane, the cyclohexane phase was decanted and the resulting washed product was dried at ambient conditions. Analysis by $HClO_4$ titration showed the presence of 7.8% unreacted amidoamine, so washed product was returned to the reactor along with enough methanol to make a slurry. Methyl chloride was again vented into the reactor, and this mixture was allowed to further react for 7 hours at 45° C. to 50° C.

The further reacted product was removed from the reactor and was placed in a vacuum oven until dry. This time, titration showed that there was less than 1% of the unreacted amidoamine left in the purified product, $C_4F_9SO_2N(H)C_3H_6N^+(CH_3)_3\ Cl^-$.

Preparation of $C_4F_9SO_2N(H)C_3H_6N^+(CH_3)_2(C_2H_5)\ C_2H_5OSO_3^-$

To a 1-L three-neck flask equipped with stirrer, reflux condenser, and thermometer were added 192 g (0.5 mole) of $C_4F_9SO_2N(H)C_3H_6N(CH_3)_2$, 550 mL of diisopropyl ether, and 84.7 g (0.55 mole) of diethyl sulfate. The mixture was stirred and heating was begun. At a temperature of 66° C., refluxing of the ether was observed. The reaction began 10 minutes after onset of reflux and was allowed to proceed during reflux for 2.5 hours. Then the ether phase was decanted from the solids, 200 mL more ether was added, and the contents were refluxed and stirred for 20 minutes. The ether phase was again decanted, and the solids were allowed to dry under ambient conditions, giving 251 g of $C_4F_9SO_2N(H)C_3H_6N^+(CH_3)_2(C_2H_5)\ C_2H_5OSO_3^-$, the desired product (73% yield).

Preparation of $C_4F_9SO_2N(C_2H_5)C_2H_4O(C_2H_4O)_{8.5}H$

To a glass pressure reactor were charged 148.4 g (0.4 mole) of N-ethyl-N-(2-hydroxyethyl) perfluorobutanesulfonamide, $C_4F_9SO_2N(C_2H_5)C_2H_4OH$, and 2.5 g of boron trifluoride etherate, $BF_3.O(C_2H_5)_2$. The mixture was heated to 80° C. and 149.6 g (3.4 moles) of ethylene oxide from a pressurized cylinder was added over several hours. The reaction was very exothermic so no further heat was applied during the reaction time. After cooling, the contents of the vessel were weighed, showing 294 g of crude product. This crude product was passed through an ion exchange column to remove residual $BF_3$ and was filtered to remove insoluble impurities. 272 g of purified product $C_4F_9SO_2N(C_2H_5)C_2H_4O(C_2H_4O)_{8.5}H$, was recovered, indicating a 91% yield.

Preparation of $C_3F_7C(O)N(H)C_3H_6N^+(C_2H_5)_2CH_2CH_2COO^-$ $C_3F_7C(O)N(H)C_3H_6N^+(C_2H_5)_2CH_2CH_2COO^-$ was prepared as described the preparation of $C_6F_{11}C(O)N(H)C_3H_6N^+(CH_3)_2C_2H_4COO^-$, except that perfluorobutyryl fluoride was substituted for undecafluorocyclohexanecarbonyl fluoride and N,N-diethyl-3-aminopropyl amine was substituted for N,N-dimethyl-3-aminopropyl amine.

Preparation of $C_6F_{13}SO_2N(C_2H_4COOH)C_3H_6N(CH_3)_2$

The preparation $C_6F_{13}SO_2N(C_2H_4COOH)C_3H_6N(CH_3)_2$ is described in U.S. Pat. No. 5,144,069 (Stern et al.).

Preparation of $C_6F_{13}SO_2N(CH_2CH(OH)CH_3^-)C_3H_6N^+(CH_3)_2C_2H_4OH$

This compound can be prepared as described in U.S. Pat. No. 5,207,996, Example 1.

Preparation of $C_4F_9SO_3^-K^+$

The preparation of $C_4F_9SO_3^-K^+$ is described in U.S. Pat. No. 2,732,398 (Brice et al.), Example 3, except that $CH_3(CH_2)_3SO_2Cl$ is substituted for $(CH_3)_2CH(CH_2)SO_2Cl$ in the electrofluorination step.

Preparation of $C_8F_{17}SO_3^-K^+$

The preparation of $C_8F_{17}SO_3^-K^+$ is described in U.S. Pat. No. 2,732,398, Example 5. This product is available from 3M Co. as Fluorad™ Fluorochemical Surfactant FC-95.

$C_{10}F_{21}SO_3^-NH_4^+$

This compound is available from 3M Co. as Fluorad™ Flurorchemical Surfactant FC-120, as a 25% active (by weight) aqueous solution.

Preparation of $C_2F_5SO_2N(H)C_3H_6N^+(CH_3)_3I^-$ $C_2F_5SO_2N(H)C_3H_6N^+(CH_3)_3I^-$ can be prepared as described in U.S. Pat. No. 2,759,019 (Brown et al.) except that $C_2F_5SO_2F$ is substituted for $CF_3(CF_2)_7SO_2F$ and N,N-dimethyl-3-aminopropyl amine is substituted for beta-diethylaminoethyl amine.

Preparation of $C_3F_7SO_2N(H)C_3H_6N^+(CH_3)_3I^-$ $C_3F_7SO_2N(H)C_3H_6N^+(CH_3)_3I^-$can be prepared as described in U.S. Pat. No. 2,759,019 (Brown et al.) except substituting $C_3F_7SO_2F$ for $CF_3(CF_2)_7SO_2F$ and N,N-dimethyl-3-aminopropyl amine for beta-diethylaminoethyl amine.

$C_8F_{17}SO_2N(C_2H_5)C_2H_4O(C_2H_4O)_6CH_3$

This compound is available from 3M Co. as Fluorad™ Fluorochemical Surfactant FC-171.

$C_8F_{17}SO_2N(H)C_3H_6N^+(CH_3)_3Cl^-$

This compound is available from 3M Co. as Fluorad™ Fluorochemical Surfactant FC-754, as a 50% active (by weight) aqueous solution.

EXAMPLE 1

Ten grams of a 1% by weight solution of $C_4F_9SO_2N(C_2H_4COOH)C_3H_6N(CH_3)2$ in electrolyte was diluted to 2000 g with electrolyte (to give 50 ppm fluorosurfactant). This resulting electrolyte solution was warmed to 100° F. (37.8° C.), and then placed in the electrowinning cell. The solution flow rate was set at 10 mL/min, and a current of 6 amps was applied to the cell. After current was applied, no acid mist was evident yet no appreciable foaming was noted in the cell. The cell was operated for 10 minutes to insure that equilibrium conditions had been established, then the strip of pH paper was suspended over the cell. After 72 additional minutes, the pH paper recorded a pH of 2–3 (it never reached a true pH of 2), indicating good mist suppression.

COMPARATIVE EXAMPLE C1

The same procedure was followed as in Example 1 except that no fluorosurfactant was added to the tankhouse electrolyte. Within 15 seconds after the strip of pH paper was suspended, this control sample recorded a pH of 2, reflecting the fact that a significant amount of acid mist was being generated.

COMPARATIVE EXAMPLE C2

The same procedure was followed as in Example 1 except that 20 g of solid polypropylene microspheres of 3–5 mm average diameter (available from Zeneca Specialties) was used instead of fluorosurfactant. These microspheres represent the state-of-the art physical barrier technology used by the copper electrowinning industry. The pH paper strip registered a pH of 2 within 9 minutes after the strip was suspended, indicating moderate mist suppression.

COMPARATIVE EXAMPLE C3

Six grams of the 1% by weight solution of $C_4F_9SO_2N(C_2H_4COOH)C_3H_6N(CH_3)_2$ in electrolyte was diluted to 2000 g with electrolyte (to give 30 ppm fluorosurfactant). This resulting surfactant solution was warmed to 100° F. (37.8° C.) and placed in the electrowinning cell. Twenty grams of polypropylene spheres, 3–5 mm average diameter, were also placed in the electrowinning cell. The cell was then tested as in Example 1. The pH paper strip registered a pH of 2 after the strip had been suspended for 77 minutes, indicating mist-suppression similar to that of Example 1 which utilized 50 ppm fluorosurfactant in electrolyte and no spheres.

COMPARATIVE EXAMPLE C4

The same procedure was followed as in Example 1 except that instead of the surfactant used in Example 1, 2.00 g of a 1% by weight solution in deionized water of Fluorad™ Fluorochemical Surfactant FC-100, an amphoteric fluorosurfactant available from 3M, was diluted to 2000 g with electrolyte (to give 10 ppm fluorosurfactant concentration) and placed in the electrowinning cell. Even though the surfactant level used was only one-fifth the level as in Example 1, a stable foam began to develop after current application. After running for 10 minutes to reach equilibrium, the pH paper strip was suspended. Although no acid mist was being generated, the foam blanket formed was of sufficient height to touch the strip and cause an immediate color change. Two minutes later, at 12 minutes running time, a new pH paper strip was suspended over the cell 2.54 cm above the liquid surface. At 21 minutes running time, foam rose high enough to touch the pH paper causing a significant color change.

At 24 minutes time, the current was discontinued, and the foam blanket was washed down with a minimal amount of deionized water to reduce the foam blanket. The solution temperature had cooled to 86° F. (30° C.). Then 0.5 mL of SX organic resin (described in the Solvent Extraction Experimental Procedure) was evenly distributed, dropwise, on the surface of the electrolyte in the electrodes. The 6 amp current was started again, and was run for 10 minutes to generate foam. At this point, a small flame from an ignited, isopropanol-soaked cotton-tipped wood applicator was held over the cell. The flame burned stronger, but nothing else was observed. After allowing the cell to run for an additional 10 minutes to generate more foam, a small flame was again placed over the cell. Nothing significant was observed. Then the current was discontinued and another 0.5 mL of SX organic resin was evenly distributed between the electrodes. The 6 amp current was again started and was run for 12 minutes to generate more foam, after which a small flame was held over the cell. Again, nothing significant was observed. The process of shutting off the current and adding another 0.5 mL of SX organic resin was repeated. Then the 6 amp current was run for 14 minutes to generate more foam, after which time a small flame was again held over the cell. This time a flash was observed. The process of shutting off the current and adding another 0.5 mL of SX organic resin was repeated a final time and then the 6 amp current was run for 12 minutes. A small flame was then held over the cell and this time an explosion in the foam which sounded like a "pop" occurred.

EXAMPLES 2–10

In Examples 2–10, the various fluorosurfactants prepared above were evaluated for solubility in the copper electrolyte, effectiveness in the electrolyte as mist suppressants, foam buildup (using the Foam and Mist Suppression Jar Test), and surface tension in the electrolyte as measured by the Surface Tension Measurement Procedure. Mist supression and amount of foam buildup were also evaluated after extraction by the SX organic resin ("after SX cycle"). In the Mist Suppression Test, all surfactants were evaluated at 50 ppm in the electrolyte, and a current of 1.1 amps was run for a total of 3 minutes. For surface tension measurements, a concentration of 39 ppm in the electrolyte was used. The following definitions were used to describe foam buildup: "Almost no foam" means less than a 3 mm wide area of foam was formed on each side of the anode; "Low foam" means foam was formed covering more than a 3 mm wide area on each side of the anode but covering no more than 50% of the liquid surface; "Very thin foam" means foam less than 1 mm thick covering more than 50% of the liquid surface; "Foam blanket" means foam at least 1 mm thick covering the entire liquid surface. The results of these tests are summarized in Table 1.

TABLE 1

| | | | | Initial | | After SX Cycle | |
|---|---|---|---|---|---|---|---|
| Ex. | Fluorosurfactant | Surface Tension | Solubility | Mist Supp. | Foam | Mist Supp. | Foam |
| 2 | $C_4F_9SO_2N(C_2H_4COOH)C_3H_6N(CH_3)_2$ | 51.60 | good | good | almost no foam | good | almost no foam |
| 3 | $C_6F_{11}C(O)N(H)C_3H_6N^+(CH_3)_2CH_2CH_2COO^-$ | 56.09 | good | good | almost no foam | good | almost no foam |
| 4 | $C_6F_{11}C(O)N(H)C_3H_6N(CH_3)_2$ | 55.22 | good | good | almost no foam | good | almost no foam |
| 5 | $CF_3C_6F_{10}C(O)N(H)C_3H_6N^+(CH_3)_2CH_2CH_2COO^-$ | 29.75 | good | good | very thin foam layer | good | almost no foam |

TABLE 1-continued

| Ex. | Fluorosurfactant | Surface Tension | Solubility | Initial Mist Supp. | Initial Foam | After SX Cycle Mist Supp. | After SX Cycle Foam |
|---|---|---|---|---|---|---|---|
| 6 | $C_6F_{13}SO_3\text{-}K^+$ | 49.18 | good | good | almost no foam | good | almost no foam |
| 7 | $C_2F_5C_6SO_3\text{-}K^+$ | 42.03 | good | good | almost no foam | good | almost no foam |
| 8 | $C_4F_9SO_2N(H)C_3H_6N^+(CH_3)_3Cl^-$ | 45.28 | good | good | low foam | good | almost no foam |
| 9 | $C_4F_9SO_2N(H)C_3H_6N^+(CH_3)_2C_2H_5C_2H_5OSO_3\text{-}$ | 54.26 | some insol. | good | low foam | good | almost no foam |
| 10 | $C_4F_9SO_2N(C_2H_5)C_2H_4O(C_2H_4O)_{8.5}H$ | 27.17 | hazy dispersion | good | low foam | poor | almost no foam |

The data in Table 1 show that all of the fluorosurfactants performed well at reducing mist formation while providing little or no foam blanket. Most of these fluorosurfactants performed equally well after an SX extraction cycle, indicating they were not significantly removed.

COMPARATIVE EXAMPLES C5–C14

In Comparative Examples C5–C14, the same test procedure was used as with Examples 2–10 except the compositions were not evaluated after extraction by SX organic resin. The test results are summarized in Table 2.

TABLE 2

| Comp. Ex. | Fluorosurfactant | Surf Tens. | Solubility | Mist Supp. | Foam |
|---|---|---|---|---|---|
| C5 | $C_3F_7C(O)N(H)C_3H_6N^+(C_2H_5)_2CH_2CH_2COO^-$ | 65.39 | good | poor | no foam |
| C6 | $C_6F_{13}SO_2N(C_2H_4COO)C_3H_6N(CH_3)_2$ | 21.75 | good | good | 5 mm foam blanket |
| C7 | $C_6F_{13}SO_2N(CH_2CH(OH)CH_2SO_3\text{-})C_3H_6N^+(CH_3)_2C_2H_4OH$ | 18.43 | good | good | 6 mm foam blanket |
| C8 | $C_4F_9SO_3\text{-}F^+$ | 67.41 | good | poor | no foam |
| C9 | $C_8F_{17}SO_3\text{-}K^+$ | 20.52 | good | good | 3 mm foam blanket |
| C10 | $C_{10}F_{21}SO_3\text{-}NH_4^+$ | 18.60 | good | good | 3 mm foam blanket |
| C11 | $C_2F_5SO_2N(H)C_3H_6N^+(CH_3)_3I^-$ | 71.62 | incompat. | poor | no foam |
| C12 | $C_3F_7SO_2N(H)C_3H_6N^+(CH_3)_3I^-$ | 72.34 | incompat. | poor | no foam |
| C13 | $C_8F_{17}SO_2N(C_2H_5)C_2H_4O(C_2H_4O)_6CH_3$ | 19.61 | hazy dispersion | poor | almost no foam |
| C14 | $C_8F_{17}SO_2N(H)C_3H_6N^+(CH_3)_3Cl^-$ | 15.06 | good | good | 3 mm foam blanket |

The data in Table 2 show that compositions with surface tensions either too high or too low, did not provide the combination of good mist suppression with little or no foam cover. They either provided poor mist suppression or mist suppression with a foam blanket.

Various modifications and alterations of this invention will be apparent to those skilled in the art without departing from the scope and spirit of this invention and the latter should not be restricted to that set forth herein for illustrative purposes.

What is claimed is:

1. A method for recovery of metal values comprising the steps of (A) leaching metal ore with an aqueous acidic solution to produce an aqueous acidic solution containing metal values, (B) liquid-liquid solvent extraction of said metal values from said aqueous acidic solution containing metal values to produce an organic solvent solution containing metal values, (C) stripping of said metal values from said organic solvent solution containing metal values into an acidic aqueous electrolyte containing strong acid to produce an electrolyte solution containing metal values, (D) electrowinning of said metal values from said electrolyte containing metal values in an electrolytic cell, said cell comprising one or more insoluble anodes and a metallic cathode, and (E) recycling said electrolyte after step (D) for re-use in step (C) wherein the improvement comprises electrowinning said metal values from electrolyte containing sufficient fluoroaliphatic surfactant to inhibit the formation of acidic mist above said electrolyte, wherein said surfactant is soluble in said electrolyte, is not significantly extracted into said organic solvent solution, does not interfere with the solvent extraction step, and does not form a foam blanket on the surface of said electrolyte during said electrowinning step.

2. The method of claim 1 wherein said metal ore is copper ore.

3. The method of claim 1 wherein said surfactant is added to said electrolyte in an amount sufficient to reduce the surface tension thereof to from 25 to 65 dynes per cm at 25° C.

4. The method of claim 1 wherein said surfactant is $(R_f)_n(Q)_xZ$ wherein $R_f$ is a fluoroaliphatic radical containing 4 to 8 carbon atoms, n is 1 or 2, Q is a linking group, x is 0 or 1, and Z is a water-solubilizing polar group or moiety such that the fluoroaliphatic surfactant is not significantly extracted into the organic solvent and does not cause emulsification during the solvent extraction step.

5. The method of claim 4 wherein n is 1 and said fluoroaliphatic radical is $C_yF_{2y+1}$ where y is 4, 5, or 6.

6. The method of claim 4 wherein n is 1 and said fluoroaliphatic radical is cycloaliphatic and $C_yF_{2y-1}$ where y is 6, 7, or 8.

7. The method of claim 1 wherein said surfactant is $C_4F_9SO_2N(C_2H_4COOH)C_3H_6N(CH_3)_2$.

* * * * *

UNITED STATES PATENT AND TRADEMARK OFFICE

CERTIFICATE OF CORRECTION

PATENT NO.: 5,468,353

DATED: November 21, 1995

INVENTOR(S): Ann T. Anich and Michael J. Sierakowski

It is certified that error appears in the above-identified patent and that said Letters Patent is hereby corrected as shown below:

Col. 1, line 9, "Solvent" should read -- solvent --.

Col. 8, line 11, "tort" should read -- torr --.

Col. 8, line 18, "Undecafluorocyclohexane" should read -- undecafluorocyclohexane --.

Col. 8, line 57, "$CF^3$" should read -- $CF_3$ --.

Col. 9, line 17, after "$H_6$" insert -- N --.

Col. 10, line 13,

"$C_6F_{13}SO_2N(CH_2CH(OH)CH_3^-)C_3H_6N^+$" should read

-- $C_6F_{13}SO_2N(CH_2CH(OH)CH_2SO_3^-)C_3H_6N^+$ --.

Col. 13, In Table 1, Example 7, under Column heading Fluorosurfactant,

"$C_2F_5C_6SO_3^-K^+$" should read -- $C_2F_5C_6F_{10}SO_3^-K^+$--.

Col. 13, In Table 2, Example, C6 under Column heading Fluorosurfactant,

"$C_6F_{13}SO_2N(C_2H_4COO)C_3H_6N(CH_3)_2$" should read

-- $C_6F_{13}SO_2N(C_2H_4COOH)C_3H_6N(CH_3)_2$ --.

UNITED STATES PATENT AND TRADEMARK OFFICE

CERTIFICATE OF CORRECTION

PATENT NO. : 5,468,353

DATED : Nov. 21, 1995

INVENTOR(S) : Ann T. Anich, et al.

It is certified that error appears in the above-indentified patent and that said Letters Patent is hereby corrected as shown below:

Col. 13, In Table 2, Example C8, under Column heading Fluorosurfactant, "$C_4F_4SO_3^-F^+$" should read

– $C_4F_9SO_3^-K^+$ –

Signed and Sealed this

Twenty-sixth Day of March, 1996

*Attest:*

*Attesting Officer*

BRUCE LEHMAN

*Commissioner of Patents and Trademarks*